US005509656A

United States Patent [19]

Berger et al.

[11] Patent Number: 5,509,656

[45] Date of Patent: Apr. 23, 1996

[54] ELECTRONIC MAZE PUZZLE

[75] Inventors: Howard H. Berger, Hermosa Beach; Gary T. Yamron, Redondo Beach; Richard Perkins, Playa Del Rey, all of Calif.

[73] Assignee: Image Design & Marketing, El Segundo, Calif.

[21] Appl. No.: 142,787

[22] Filed: Oct. 25, 1993

[51] Int. Cl.[6] ..... A63F 9/06

[52] U.S. Cl. ..... 273/153 R; 273/156

[58] Field of Search ..... 273/153 R, 153 S, 273/155, 156, 157 R

[56] References Cited

U.S. PATENT DOCUMENTS

| | | | |
|---|---|---|---|
| 3,737,168 | 6/1973 | Driskill | 273/156 |
| 3,819,187 | 6/1974 | Downs | 273/156 |
| 3,824,815 | 7/1974 | Darling | 273/156 X |
| 4,065,132 | 12/1977 | Giakas | 273/153 R |
| 4,311,310 | 1/1982 | Dankman et al. | 273/153 R |
| 4,320,901 | 3/1982 | Morrison et al. | 273/153 R |
| 4,357,016 | 11/1982 | Allison | 273/156 |
| 4,796,891 | 1/1989 | Milner | 273/153 S |
| 4,805,910 | 2/1989 | Monticolombi et al. | 273/153 R |
| 4,817,952 | 4/1989 | Biró et al. | 273/153 S |
| 4,974,848 | 12/1990 | Gieseker | 273/153 R |
| 4,989,872 | 2/1991 | Urrestarazu Borda | 273/153 R |
| 5,205,557 | 4/1993 | Kuo | 273/153 S |
| 5,259,619 | 11/1993 | Rosewarne | 273/153 R |
| 5,310,184 | 5/1994 | Grist | 273/153 R |
| 5,314,181 | 5/1994 | Lin | 273/153 R |

FOREIGN PATENT DOCUMENTS

| | | | |
|---|---|---|---|
| 2070943 | 9/1981 | United Kingdom | 273/153 R |

*Primary Examiner*—Jessica J. Harrison
*Attorney, Agent, or Firm*—Wagner & Middlebrook

[57] ABSTRACT

A maze puzzle is disclosed employing a concealed maze pattern on one member and a second member movable with respect to the first member and including a pin or follower which engages the maze pattern. A plurality of switches are located in various positions in the maze pattern and are operated as a pin passes each point. A sound generator producing an appropriate audible signal provides an audible message to the player. A similar generator provides a power for visual indicators such as a liquid crystal display or light emitting diode. A key member is either concealed or locked within the puzzle until a certain level of successful performance of the puzzle is achieved. The key may be used to open a secret compartment in the puzzle.

29 Claims, 4 Drawing Sheets

ELECTRONIC MAZE PUZZLE

FIELD OF THE INVENTION

This invention related to the field of hand held maze puzzles which are manually operated to move an operator with respect to a maze body from a start to a finish position through a concealed maze pattern, through trial, error and memory.

BACKGROUND OF THE INVENTION

In the co-pending patent application of Fenton Rosewarne, Ser. No. 07/830,383, filed Feb. 3, 1992, now U.S. Pat. No. 5,259,619, a new family of maze puzzles is disclosed which provide for several advantages over previous maze puzzles. Of prime importance is the feature that the Rosewarne maze pattern is concealed within a maze body. As the puzzle is worked and a pin or follower traverses the maze more and more of an operator becomes exposed but the maze pattern remains concealed. Likewise, the maze of the previous Rosewarne invention provides for various tactile indications of progress but does not rely upon the pin from rubbing along the side wall of the groove as an indication of side paths or other clues. The Rosewarne maze puzzle provides an indication of successful completion only at the final step. If all steps through the final step are not completed successfully, the only allowable action is to return to the starting level.

All together the Rosewarne maze, or as they are termed "Fenton's Maze" provide a challenge to puzzle enthusiastic, not previously available.

| | | |
|---|---|---|
| 3,819,187 | G.W. Downs | June 25, 1974 |
| 4,805,910 | Monticolombi et al. | Feb. 21, 1989 |
| 4,974,848 | G.A. Gieseker | Dec. 4, 1990 |
| 3,824,815 | W.A. Darling | July 23, 1974 |
| 4,065,132 | W. Giakas | Dec. 27, 1977 |
| 4,357,016 | M.H. Allison | Nov. 2, 1982 |

BRIEF DESCRIPTION OF THE INVENTION

The applicants have carefully reviewed "Fenton's Maze" and have come to the recognition that each of the features of those mazes may be retained and through the addition of certain electronic features, the challenge to the player can be increased and in addition to the tactile clues given in the mechanical "Fenton's Maze", audible and visual clues can be incorporated into the puzzle for enhanced challenge and enjoyment.

In accordance with the new features of this invention, certain of the tactile clues of the mechanical maze are replaced or augmented with an electrical contact located in the maze grooves and the contacts are connected to a power source such as an internal battery and sound source which includes recorded audible clues.

Basically the maze employs a body carrying a concealed maze pattern of grooves lining the walls of a circular recess. An operator carrying a pin or follower fits into the recess in the body. The pin travels in the maze grooves. Positioned at various preselected points in the maze pattern are a number of switches operated by the passage of the pin. The switches energize sound or light signals which are powered by an internal battery. The audible or light signal give clues, warning or other enhancement of the steps of puzzle solution.

Additional mechanical features are incorporated in the puzzle such as the mechanical release of a "key" after reaching a level of accomplishment and the key can be used to open a prize compartment or begin a new phase of the puzzle.

DETAILED DESCRIPTION OF THE INVENTION

Figure 1:
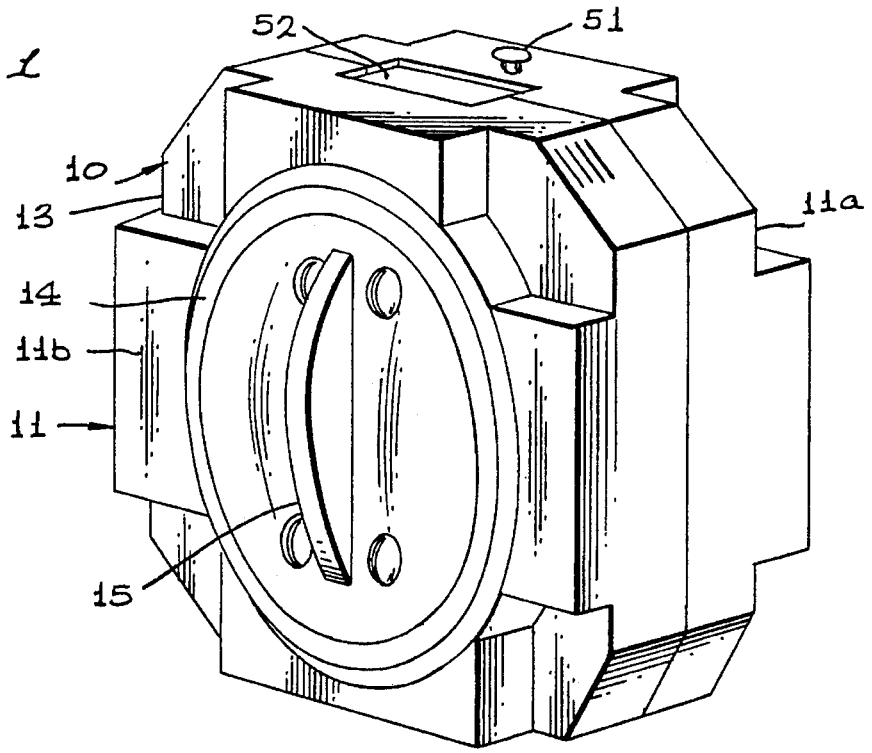
FIG. 1 is a perspective view of one embodiment of this invention.

Electronic maze puzzles in accordance with this invention may have many different themes and external appearances and features. In FIGS. 1 through 7 and 10 the preferred embodiment is shown incorporating the basic elements with a "Fenton's Maze" with important additional features presenting an augmented challenge to the players. This includes audible as well as tactile clues and a prize function upon successful solution of the maze. In the embodiment of FIGS. 1 through 4, the maze, generally designated 10, called the "Bomb Squad" in which the object is for the player to solve the maze as rapidly as possible and "disarm" the bomb by removing the "key" and gain access to a secret compartment. The compartment may enclose a prize or record of the successful solution.

In the embodiments of FIGS. 1 through 4, the maze 10 includes an exterior body or housing 11 made up of a rear housing part 11*a* and a front upper housing part 11*b* which contain all electronic maze parts, circuitry, and has an exterior which presents an appealing "high tech" look consistent with its ostensible function of a "bomb".

Figure 3:
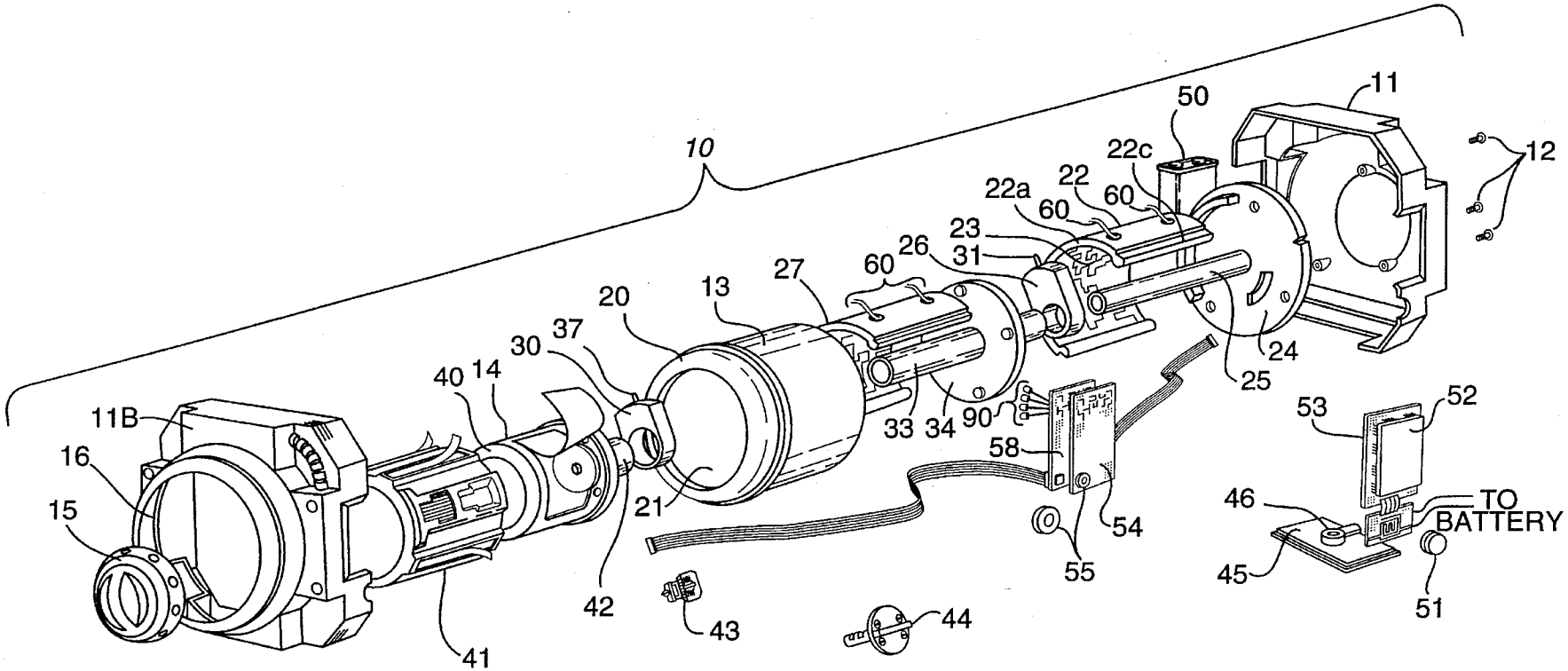
FIG. 3 is an exploded view of the embodiment of FIG. 1.
Figure 4:
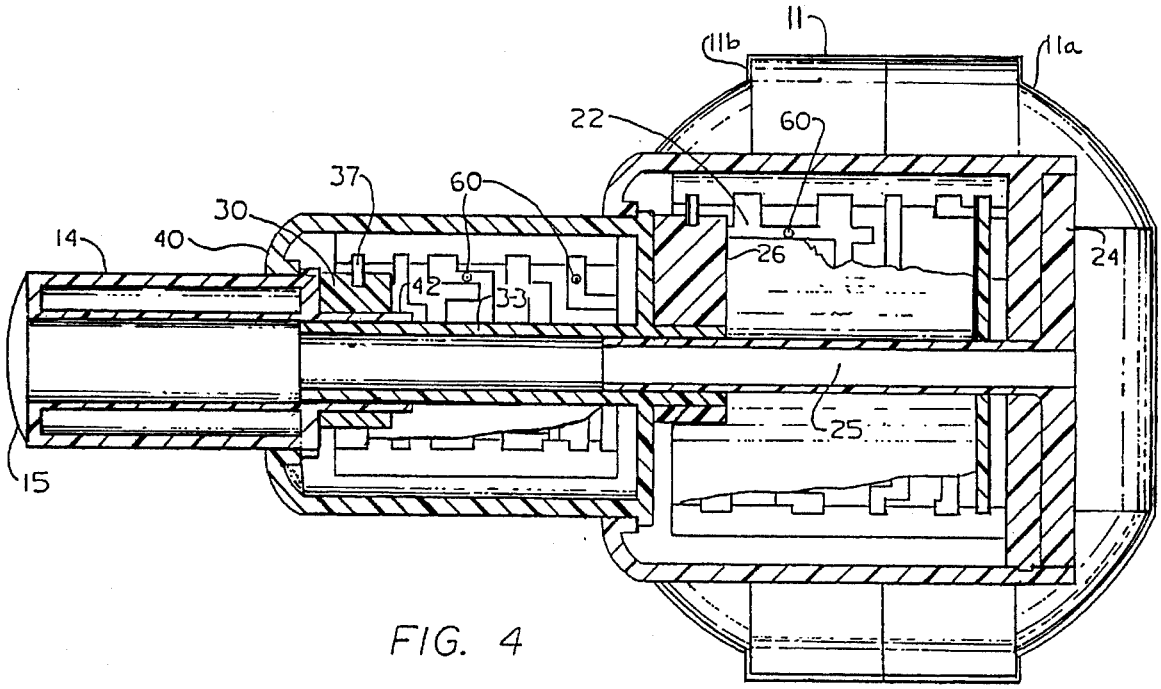
FIG. 4 is a simplified vertical diametrical sectional view of the embodiment of FIG. 2 but with the puzzle solved.

The housing 11 and most other non electrical parts are preferably injection molded colored plastic parts assembled by cementing or by fasteners such as self tapping screws 12 of FIG. 3.

Figure 2:
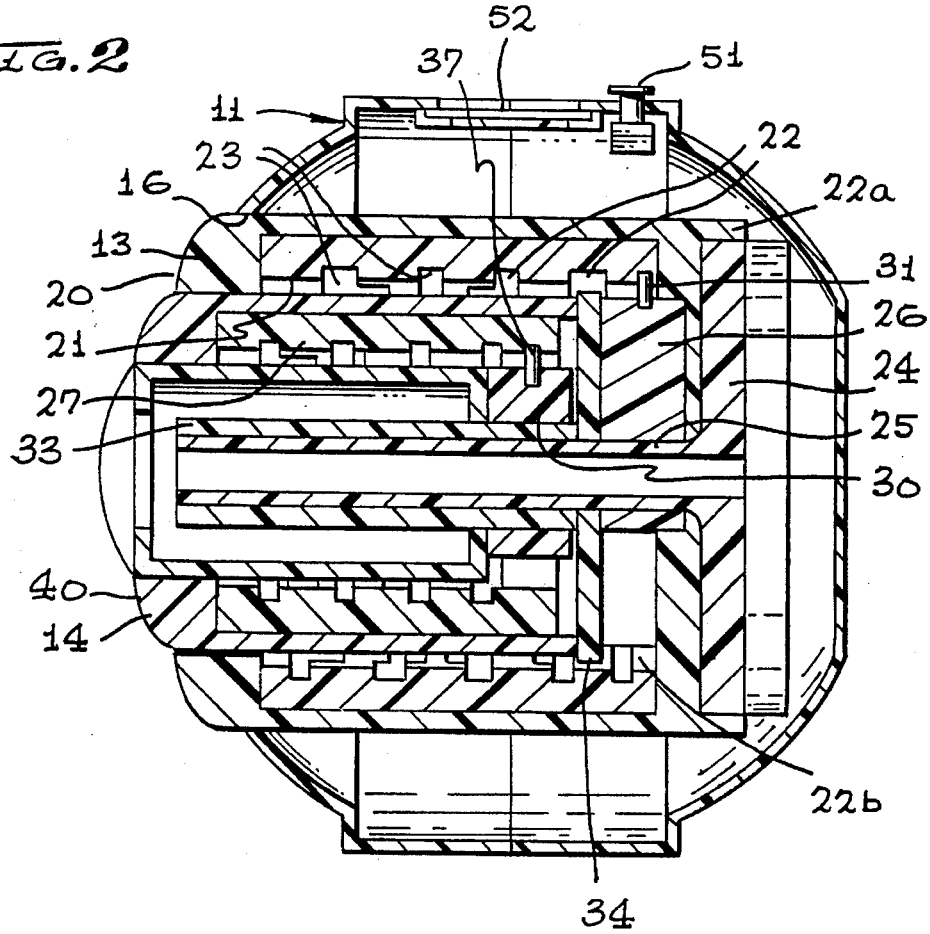
FIG. 2 is a simplified vertical diametrical sectional view of an embodiment of this invention which has a different exterior but the same operative elements.

Visible at the front of the maze 10 are the tops of a primary cylinder 13, a secondary cylinder 14 and an operator knob 15. Rotation of knob 15 either clockwise or counterclockwise plus withdrawing of knob 15 from the body 11 containing an unseen (FIG. 1) maze pattern constitutes operation of the puzzle. As shown in FIG. 2, the housing 11 includes a cylindrical recess 16 which received primary cylinder 13 with only its upper rim 20 showing. The primary cylinder 13 likewise has a cylindrical recess 21 into which a primary maze 22 is inserted during manufacture or optionally exchanged by the owner. The primary maze 22, as best seen in FIG. 3, is made up of two mating semi cylindrical parts 22*a* and 22*b* with snap lock sections 22*c* to define a cylindrical tube. In FIG. 3, part 22*b* is omitted for clarity. The primary maze pattern 23 is located on the inner surface of the primary maze 22. The primary maze 22 is locked into position within the primary cylinder 13 between its upper rim 20 and a base plate 24 which itself is secured to the housing 11 by screws 12 of FIG. 3. The base plate 24 carries an centrally located axle 25 which defines the axis of rotation of a pair of pin or follower assemblies, a lower pin assembly 26 and an upper pin assembly 30, the latter is associated with a secondary maze described below.

The lower pin assembly 26 carries a spring loaded or fixed pin 31 which rides in the grooves of the primary maze 22. The primary and secondary mazes, 22 and 27 are preferably of the type disclosed in the co-pending application of Fenton Rosewarne, identified above.

In addition to the characteristics of the mechanical Rosewarne maze, this invention employs a number of electrical switches in the maze patterns which are operated by the pin 31 and its counterpart pin 37 in the secondary maze 27. The functions of these switches are disclosed below.

The upper pin assembly 30 actually rides on a central axle 33 which encircles the base axle 25 located on longitudinally moveable plate 34.

The secondary maze 27, structurally similar to primary maze 22 but with a different maze pattern is positioned between plate 34 and the upper rim 40 of top cylinder 14. Secondary pin assembly 30 rotates on shaft 42 with pin 37 engaging the groove of secondary maze pattern 27.

Referring now specifically to FIG. 3, the secondary cylinder 14 has a "high tech" exterior sleeve 41 which is visible when it is fully exposed. The sleeve 41 as well as the cylinder 14 has a number of adhesive labels or covers, some of which are shown partially lifted. The sleeve 41 also carries a removable member 43 which either conceals a clue or is usable mechanically to advance the game by releasing a key 44. The key 44 is used to open the lock 46 of door 45 of a secret compartment in the housing 11.

THE ELECTRONICS

In the maze 10 of this invention, several electronic features are present. In the base portion of housing 11 there is found a power source such as a battery 50 which powers the electronics, via start/stop switch 51, includes an LCD display 52 and its driving circuitry 53. The LCD display 52 may display messages related to the progress of the game or simply elapsed or time left to disarm the "bomb". In either of these last two cases, a simple timer circuit is included in the start/stop switch circuitry 53.

Additional circuit boards 53 and 54 mount a loud speaker 55 and an internal selector switch 56 used at the factory to select sounds.

The circuitry of this invention is powered by battery 50 when start/stop switch 51 is operative to the start position. The timer circuitry 56 is actuated by the start/stop switch 51. The remaining circuitry is activated as a function of the progress or non progress of the player in solving the maze puzzle. This is accomplished by the presence of switches located in selected regions of the maze pattern and operated by the passage of the pins 31 and 37, in the first and second cylinders 13 and 14.

Figure 5:
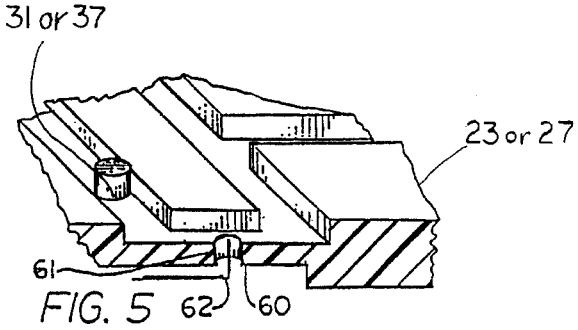
FIG. 5 is a fragmentary perspective view of a section of the maze pattern with a switch in the bottom of a maze groove.
Figure 6:
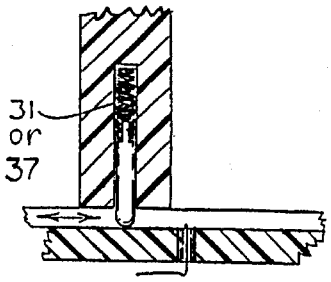
FIG. 6 is a fragmentary vertical sectional view of the switch of FIGS. 5 and 6.
Figure 7:
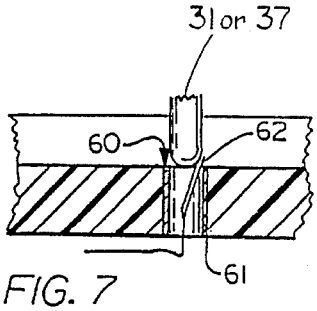
FIG. 7 is a further enlarged vertical sectional view of the switch of FIGS. 5 and 6.

Referring now to FIGS. 5–7 for a perspective view of a portion of either maze 23 or 27.

A primary form of switch employed in this invention is a whisker switch 60 including a conductive ring 61 imbedded in the maze path with a resilient probe wire 62 extending slightly above the level of the bottom of a maze track. Whenever a pin 31 or 37 traverses that section of the maze, as illustrated in FIG. 7, the pin 31 or 37 deflects the probe wire 62 into contact with the outer ring 61 to momentary close the power circuit to the sound generator circuit 54 and produce an audible sound. The sound produced is related to the position of switch 60 in the circuit and the sound generator produce an appropriate audible sound. For example, at an early level of maze puzzle accomplishment, the player may hear:

a) "Good Work", b) a bell sound, or c) a musical note.

In case the player has made a wrong turn and in accordance with the theory of the Rosewarne maze plan, must return to the starting point, he may hear:

a) "Too Bad", b) "Try Again", or Explosion Sound c) a crescendo all prerecorded at the factory and stored in the sound signal generators 54.

If time is running out as noted by a comparison of which switch has recently been operated, the player may hear:

a) "30 Seconds Left", b) Increasing rate of pulses c) Increasing rate of pitch or volume If any of these examples sound, a message may also be displayed on the LCD 52 of FIG. 3. Also, when employing the switch 60 of FIG. 5, the player typically will receive a tactile signal, as well, as the pin 31 or 37 contacts the spring wire 61.

Figure 8:
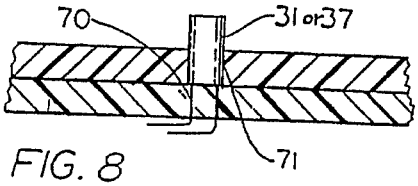
FIG. 8 is a fragmentary vertical sectional view of an alternate embedded switch using a conductive maze engaging pin.
Figure 9:
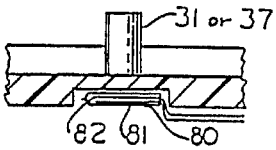
FIG. 9 is a fragmentary vertical sectional view of an alternate magnetic switch using a ferromagnetic maze engaging pin.

Two other forms of switches are disclosed in FIGS. 8 and 9. In FIG. 8, a pair of totally imbedded contacts 70 and 71 are located in the maze, preferably in the bottom of the track. In that case, the contacts 70 and 71 are spaced less than the diameter or length of the pins 31 and 37 and the pins are conductive. The pin 31 or 37 bridges the space between the conductors 70 and 71, momentarily, as it passes the conductors, closing the enabling circuit for the sound generator.

Another form of switch arrangement which is non contacting is disclosed in FIG. 9. In that case, the pins 31 and 37 are small permanent magnets and positioned below a thin section of the maze track with a magnetic reed relay 80 outside of the maze track. The contacts 81 and 82 are closed by the passage of the magnetic pin 31 or 37.

Of these forms of switches, the form as shown in FIGS. 5–7 is preferred since it gives both a tactile signal by mechanical contact between the pin 31 or 37 and the probe 61 and triggers an electronically generated audible signal or message.

Figure 10:
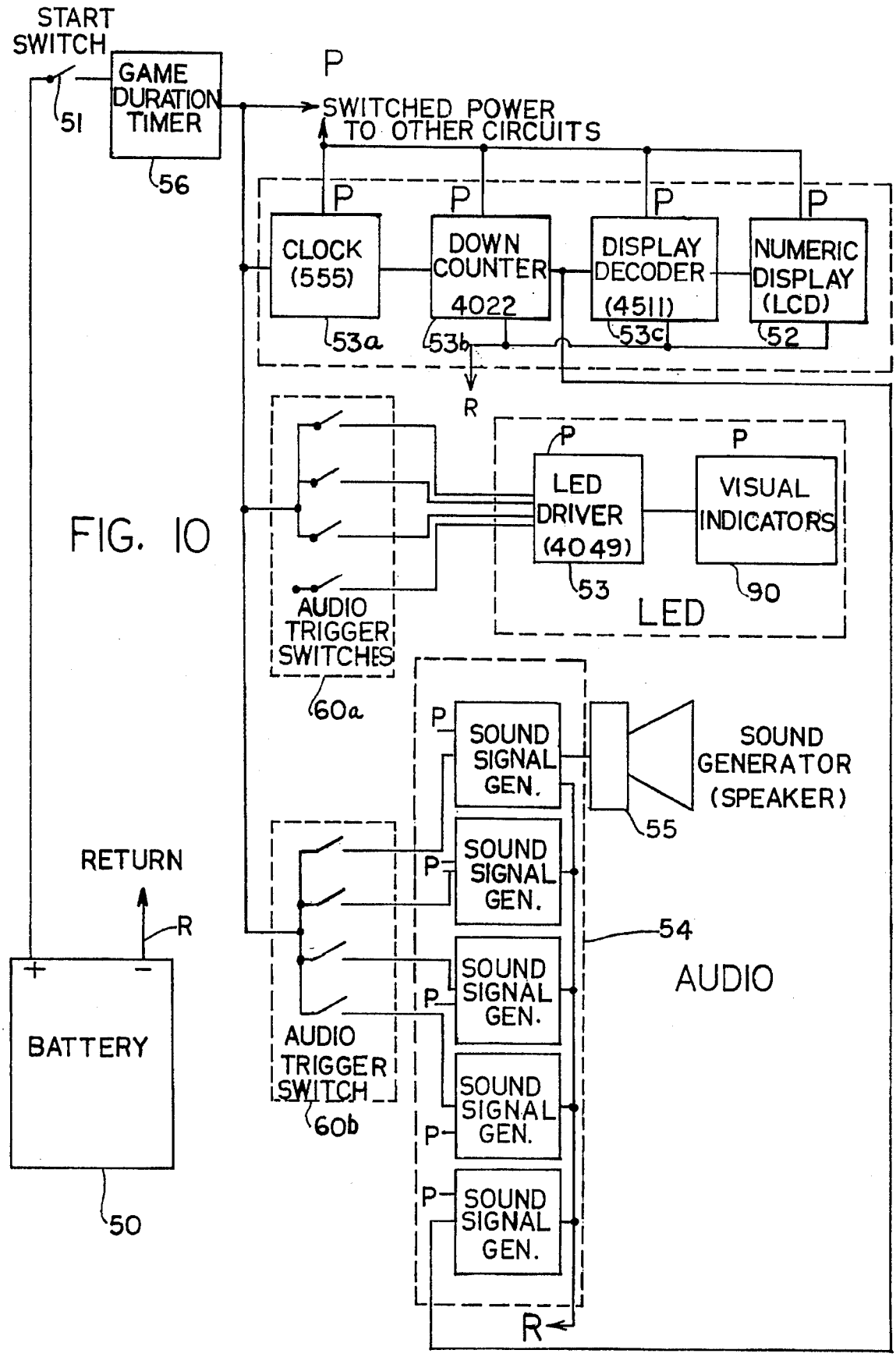
FIG. 10 is a simplified electrical block diagram for this invention.

The circuitry of the preferred embodiment is illustrated in FIG. 10. It includes the battery 50, start switch 51, the LCD display 52, and its LCD driver circuit 53 *a–c*, a timer 56, a series of LED's 90 and their driver circuit 53 as well as a loud speaker 55 and its driver circuit 54.

Also controlled by the start switch 51 and a plurality of maze pattern located switches 60 *a–d*, 70, or 80 is the sound generating circuit 54. As described above, the sounds generated are related to the particular locations of each switch 60.

Upon operation of the start switch 51, the game timer 56 is operated providing switched power to all other circuits, over lead P and initiating clock 53 a in the LCD array and enabling all switches 60*a* and 60*b* located to be operated by passage of the operators 31 and 37 in their mazes. Also included in the circuitry of FIG. 10 and the displays are a number of light emitting diodes 90 which are exposed to the player and controlled either by the timer 56 or the maze pattern positioned switches 60. Typical visual signals can be:

| LED COLOR | INDICATION |
|---|---|
| Green | any "on track" positions or "You have reached the decoder. Remove it for a clue or prize." |
| Yellow | "Be careful." |
| Red | "Wrong direction." |
| Flashing Red | "Time running out." |

Examples of suitable commercially available electronic chips for carrying out this invention are:

| | PART TYPE | SOURCE | LOCATIONS |
|---|---|---|---|
| Timer 56 | 555 timer | Tandy Corp | Fort Worth Texas |
| Clock 53a | 555 timer | Tandy Corp | Fort Worth Texas |
| Down Comt.53b | 4029 timer | Tandy Corp | Fort Worth Texas |
| Display Decade.53c | 4511 timer | Tandy Corp | Fort Worth Texas |
| Numeric | LCD3 | Hitachi Corp | Van Nuys, CA |
| Display 52 LED Driver 53 | 4049 | Tandy Corp | Fort Worth Texas |
| Visual Indictor.90 | LED's versions | Tandy Corp | Fort Worth Texas |
| Sound Signal Generator.54 | ISD 1000A | Tandy Corp | Fort Worth Texas |

In the foregoing description, one particularly attractive embodiment of this invention is described. It must be realized that the external appearance of the body and operator as well as the theme or appearance of the muzzle may be changed without varying from the basic concept of this invention. Therefore, the foregoing embodiment must be considered only illustrative and not limiting. The scope of this invention, instead is defined by the following claims including the benefit of the doctrine of equivalents.

We claim:

1. A maze puzzle comprising a puzzle body including a recess defining a generally cylindrical cavity in the body;

a maze pattern within said recess located on the cylindrical wall of the body;

said maze pattern comprising a series of interconnected grooves extending from a starting position generally toward the bottom of the recess to a final position groove generally toward the surface of the recess adjacent to the surface of said puzzle body but concealed therein;

said maze pattern including a plurality of paths with at least one of which extends from the starting point to the final groove and a plurality of other paths which extend from the starting point but do not provide a complete path to the final groove;

a plurality of electrical switch means each of said switch means associated with and located at concealed different locations in several of said grooves;

a power source connected to said switch means;

a signal generator powered by said power source through said electrical switch means;

an operator positioned in said recess including graspable means for rotating and extending the operator out of said recess in the process of solving the maze puzzle;

said operator including maze engaging a means for traveling in the grooves of said maze pattern and operative in the region of said switch means for operating such switch means whereby said engaging means as it travels past a switch means powers said signal generator to provide a signal to the puzzle player related to the position of the switch means operated.

2. A maze puzzle in accordance with claim 1 wherein said switch means are located in said recess of said body on the opposite side of said cylindrical wall from said maze pattern with a switch element in switch operating relationship with said maze engaging means.

3. A maze puzzle in accordance with claim 2 wherein said switch element includes a deflectable member which partly extends into the groove at the selected position in the maze and deflectable in response to contact by said maze engaging means to operate the signal generator and to provide a tactile signal to the user.

4. A maze puzzle in accordance with claim 1 wherein said signal generator produces an audible signal upon operation of said switch means.

5. A maze puzzle in accordance with claim 1 wherein said signal generator provides an operating signal for a visual indicator and including a visual indicator.

6. A maze puzzle in accordance with claim 5 wherein said visual indicator includes at least one light emitting diode.

7. A maze puzzle in accordance with claim 6 including timer means for timing operator time in solving the maze puzzle.

8. A maze puzzle in accordance with claim 7 wherein said timer means is operative to count down from a preset time to 0 time, said timer means being operative to enable said signal generator to produce an audible signal.

9. A maze puzzle in accordance with claim 5 wherein said visual indicator comprises a digital display.

10. A maze puzzle in accordance with claim 9 wherein said digital display comprises a liquid crystal display.

11. A maze puzzle in accordance with claim 1 wherein said maze engaging means is conductive and said electrical switch means includes switch contacts in the groove of said maze pattern and said maze engaging means is operative to provide a switch closing electrical path as it passes by said switch contacts.

12. A maze puzzle in accordance with claim 1 wherein said maze engaging means is ferromagnetic and said electrical switch means is operated by the nearby passage of ferromagnetic material.

13. A maze puzzle comprising:

a body including a recess in one surface thereof having a cylindrical wall;

a maze pattern on the cylindrical wall of said recess;

an operator member extending into said recess including a follower engaging said maze pattern to allow the operator member to move from an innermost position in said body to an outermost position as controlled by said maze pattern;

a key removable secured to said maze puzzle and restrained from removal unless said operator member is at a preselected position; and a locked compartment in said maze puzzle openable by said key.

14. A maze puzzle in accordance with claim 13 wherein said locked compartment is in said body and said key is releasable only when the operator member has been withdrawn successfully to a predetermined extent from said body.

15. A maze puzzle in accordance with claim 14 wherein the predetermined extent comprises successful solution of the maze puzzle.

16. A maze puzzle in accordance with claim 13 including a source of power, a sound generator, at least one switch means associated with said maze pattern and responsive to passage of said follower by said switch means for activating said sound generator to provide an audible signal to a player of the puzzle.

17. In a maze puzzle, electronic signal means comprising:

a power source;

a signal generator capable of producing a perceptible signal for the maze puzzle player;

said maze puzzle including a plurality of concealed maze grooves and a concealed follower for traversing the maze grooves in the solving of the maze puzzle;

a plurality of concealed switches each associated with a preselected location in the maze puzzle;

said switches operatively connected to said power source and said signal generator;

said follower being secured to an externally manually operable portion of the maze puzzle and operative upon movement of said externally manually operable portion to operate a switch as it passes through the maze groove in which the switch is located.

18. A maze puzzle in accordance with claim 17 wherein said switches include a switch operator extending into a groove and a follower operates the switch by physical contact with the switch operators.

19. A maze puzzle in accordance with claim 18 wherein said follower is operative to cause the signal generator to function and to provide a tactile signal to the user by the physical contact with the switch operator.

20. A maze puzzle in accordance with claim 17 wherein said switches include contact means exposed in a maze groove and said follower is conductive and bridges said contact means to operate said switch.

21. A maze puzzle in accordance with claim 17 wherein said signal generator produces at least one audible signal.

22. A maze puzzle in accordance with claim 17 wherein said signal generator includes light means and produces at least one visible signal.

23. A maze puzzle in accordance with claim 22 wherein said light means comprises at least one light emitting diode located on the maze puzzle and exposed to the puzzle player during play.

24. A maze puzzle in accordance with claim 17 wherein said signal generator produces a signal for the player indicative of progress in solution of the puzzle.

25. A maze puzzle in accordance with claim 17 including a timer powered by said power source and initiated by the player for timing the player's time to solve the puzzle.

26. A maze puzzle in accordance with claim 25 wherein said signal generator is connected to said timer and is operative to give a perceptible signal to the puzzle player indicative of the timer's time count.

27. A maze puzzle in accordance with claim 17 wherein said signal generator includes a screen and means for producing a visual image on said screen indicative of the player's progress in solution of the puzzle.

28. A maze puzzle in accordance with claim 27 wherein said screen is a liquid crystal display.

29. A maze puzzle in accordance with claim 27 including a timer and said screen is operative to display the timer's time count.

* * * * *